US009055801B1

(12) United States Patent
Schuch et al.

(10) Patent No.: US 9,055,801 B1
(45) Date of Patent: Jun. 16, 2015

(54) NAIL COATING REMOVAL PAD AND RETAINER

(75) Inventors: Cathy Schuch, Green Bay, WI (US); David M. Ledvina, Luxemburg, WI (US)

(73) Assignee: Little Rapids Corporation, Green Bay, WI (US)

( * ) Notice: Subject to any disclaimer, the term of this patent is extended or adjusted under 35 U.S.C. 154(b) by 0 days.

(21) Appl. No.: 13/424,372

(22) Filed: Mar. 19, 2012

Related U.S. Application Data

(60) Provisional application No. 61/454,191, filed on Mar. 18, 2011.

(51) Int. Cl.

| | |
|---|---|
| ***A45D 29/18*** | (2006.01) |
| ***A45D 7/00*** | (2006.01) |
| ***A45D 29/00*** | (2006.01) |
| *A45D 37/00* | (2006.01) |

(52) U.S. Cl.
CPC ..... *A45D 29/007* (2013.01); *A45D 37/00* (2013.01)

(58) Field of Classification Search
USPC ..... 132/74.5, 73, 320, 73.5, 75, 200; 602/48
See application file for complete search history.

(56) References Cited

U.S. PATENT DOCUMENTS

| | | | | |
|---|---|---|---|---|
| 3,124,825 | A * | 3/1964 | Iovenko | 15/104.93 |
| 4,800,904 | A * | 1/1989 | Kinseley et al. | 132/73.5 |
| 4,860,736 | A * | 8/1989 | Kaitz et al. | 604/307 |
| 4,938,347 | A * | 7/1990 | Tillman | 206/209 |
| 6,305,383 | B1 * | 10/2001 | Thoma | 132/200 |
| 6,367,485 | B1 * | 4/2002 | Dutton-Davis et al. | 132/200 |
| 2004/0025896 | A1 * | 2/2004 | Tsukamoto | 132/74.5 |
| 2008/0014387 | A1 * | 1/2008 | Murphy et al. | 428/34.1 |

OTHER PUBLICATIONS

Thomas Hermann, Ultrasonic Bonding of NOnwoven, Films and Textiles, Nov. 2005, Textile World pp. 1-7.*
website screeshot captured Jan. 7, 2015; http://www.amazon.com/Acrylic-Color-Polish-Remover-Wraps/dp/B00FHOIWFY, for Nail Art Soak Off Acrylic Nail Color Polish UV Gel Remover Nail Wraps.
website screenshot captured Jan. 7, 2015; http://www.drugstore.com/red-carpet-manicure-remove-wraps-led-nail-gel-polish-removal-wraps/qxp487683, for Red Carpet Manicure Remove Wraps LED Nail Gel Polish Removal Wraps.
website screenshot captured Jan. 7, 2015; http://www.couturegelnailpolish.com/products/no-soak-gel-nail-polish-remover-wraps.html, for Couture "No Soak" Gel Nail Polish Remover Wraps.
website screenshot captured Jan. 7, 2015; http://www.nailpolishdirect.co.uk/nails-c92/remover-c62/shellac-remover-wraps-10-wraps-p8081, for CND Shellac Remover Wraps.
website screenshot captured Jan. 7, 2015; http://www.sensationail.com/p/essentials/gel-polish-removal-kit/, for SensatioNail® Gel Polish Removal Kit.

* cited by examiner

*Primary Examiner* — Rachel Steitz
(74) *Attorney, Agent, or Firm* — Nicholas A. Kees; Shane Delsman; Godfrey & Kahn, S.C.

(57) ABSTRACT

A nail coating removal wrap and retainer for securing a solvent pad to the digit of a user of a durable nail coating so that a solvent held by the pad is retained in contact with the nail coating to be removed. The nail coating removal wrap and retainer includes a wrap strip to which the solvent pad is bonded in a method impervious to the solvent held by the solvent pad. The wrap strip is selected or treated so that the wrap coheres to itself when wrapped around a digit of the user to releasably secure the wrap to the digit of the user while the solvent works to loosen the nail coating.

2 Claims, 2 Drawing Sheets

NAIL COATING REMOVAL PAD AND RETAINER

CROSS-REFERENCE TO RELATED APPLICATION

The present application claims priority to U.S. Provisional Application Ser. No. 61/454,191, filed on Mar. 18, 2011, the disclosure of which is incorporated herein by reference in its entirety.

BACKGROUND

The present application relates generally to a device for assisting in the removal of nail polishes from a user's hands or feet and more particularly is suited for use with new gel-based and UV cured nail coatings.

There is a growing trend in the beauty industry for natural nail manicure and pedicures. Several companies have introduced gel based nail covering to provide end-users with a long-lasting manicure or pedicure. These gel based nail coatings look like traditional nail polish but last longer. These coatings are typified by having a gel-like consistency when applied to a user's nails and then are cured in an ultra-violet (UV) light device. The curing device hardens the coating and results in a nail coating that dries quicker and extremely durable once cured. Traditional nail coatings are air dried and must be protected for a period of time after application to prevent chipping until the polish has fully cured and dried. This curing and drying make take hours from the time of application.

Leading the way were OPI Products, Inc. (OPI), and Creative Nail Design (CND); two manufactures that service the professional beauty market. CND launched Shellac™ in May of 2010, which has been very successful both with regard to their nail colors and UV curing lamps. They are currently on back-order with most of their colors and UV lamps. The gel-based polish is more expensive than traditional polish, and the coat premium as compared to traditional polish can vary from salon to salon, (typically between 30-50% more).

The advantages touted by manufactures of the gel-based nail products are no drying time, chip-free and manicures holding-up to 14 days or more. Regular nail polish dries by evaporation, which means a manicure or pedicure is not fully cured until 2-3 hours after the service. Unlike traditional nail polish, soak-off gel polish is "cured" under a UV light to dry after each coat. The typical usage of the gel-based nail coatings may include a base coat, two color coats and top coat and then lastly wiped down with alcohol to remove any tackiness.

A soak-off gel by OPI called Axxium, comes currently in 35 shades. According to an article in the New York Times this past April, Axxium is now in 5,000 salons, up from 250 salons in its first year.

Removal of the gel polish does take longer. To remove a gel polish, acetone or another solvent needs to be in contact with the "nail plate" for 10 minutes. Sometimes, a nail technician has to scrape off gel residue from the nail plate. CND is currently selling a finger wrap for the soak-off process, however, that product is cumbersome when used on a client's fingers and nearly impossible to use on the toes for pedicures.

BRIEF DESCRIPTION OF THE DRAWINGS

The accompanying drawing figures, which are incorporated in and constitute a part of the description, illustrate several aspects of the invention and together with the description, serve to explain the principles of the invention. A brief description of the figures is as follows.

DESCRIPTION

Reference will now be made in detail to exemplary aspects of the present invention which are illustrated in the accompanying drawings. Wherever possible, the same reference numbers will be used throughout the drawings to refer to the same or like parts.

A nail coating removal wrap and retainer according to the present disclosure was developed through working with end-users to determine what is critical to quality for the nail technician and end-use client. The design of the present disclosure allows for a tight fit of pad and wrap to the finger, while allowing use of the client hands during wait time. Additionally, the design has been streamlined to remove complexity and shorten application time.

Figure 1:
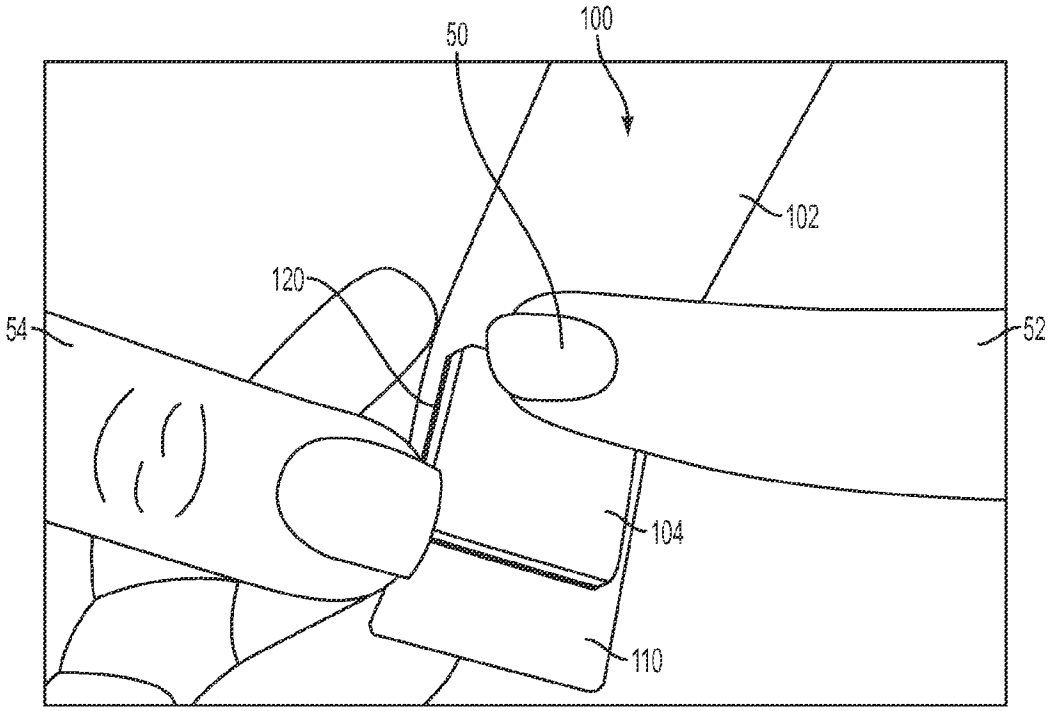
FIG. 1 illustrates a nail coating removal wrap and retainer according to the present disclosure being placed about the fingernail of a client by an aesthetician.

The image in FIG. 1 depicts a nail covering removal wrap according to the present disclosure that permits the contact time between a solvent and a nail coating while maintaining the freedom of movement of the user's hands or feet while waiting for the appropriate dwell time. In FIG. 1, a nail coating removal wrap and retainer 100 is shown being placed about a fingernail 50 of a client's finger 52 by the fingers of a nail technician or esthetician 54. Such a wrap and retainer according to the present disclosure may be used on either the hands or feet of a client, depending on whether the coating to be removed is on the fingernails or toenails of the client.

Figure 2:
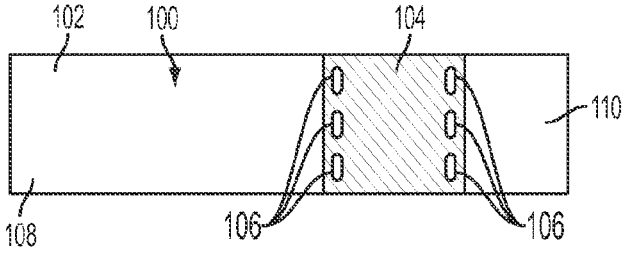
FIG. 2 is a top view of the nail coating removal wrap and retainer of FIG. 1.
Figure 3:
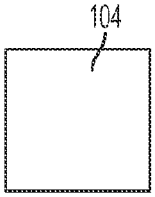
FIG. 3 is a top view of a solvent pad of the nail coating removal wrap and retainer of FIG. 1.
Figure 4:
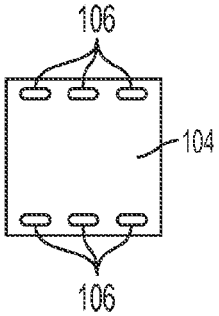
FIG. 4 is a top view of a bonding pattern for securing the solvent pad of FIG. 3 to the nail coating removal wrap and retainer of FIG. 1.
Figure 5:
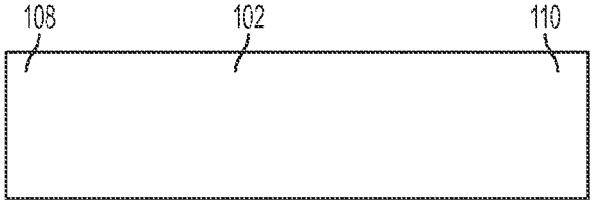
FIG. 5 is a top view of a wrap strip of the nail coating removal and retainer of FIG. 1.

FIG. 2 illustrates nail coating removal wrap and retainer 100 which may include a wrap strip 102 and a solvent pad 104. A pattern of bonds 106 may be used to secure pad 104 to wrap strip 102. Wrap strip 102 may include a first end 110 adjacent the solvent pad and a second opposite end 108. Preferably, wrap strip will have cohesive properties. When nail coating removal wrap and retainer 100 is placed about a client's nail, the wrap preferably extends around the client's digit and overlaps itself. A single coated nail may be addressed with each nail coating removal wrap and retainer 100. This will allow a nail technician or aesthetician to work on a single nail while the others are still being exposed to solvent.

Having cohesive properties will permit the securing of the wrap strip about a client's nail without the need for any additional products. The wrap strip is simply wrapped over itself and it would adhere to itself to secure the wrap to the client's finger. The cohesive properties could come from the material itself, such as the cohesive wrap strip shown in FIG. 1. The material from which this wrap strip is made is a stretchable latex free non-woven cohesive wrap similar to that used in medical wraps. No tape or additional clips, bands or other elements are required to keep the wrap strip about the client's finger tip.

It is anticipated that other similarly cohesive woven and non-woven materials may be used for the wrap strip. If it is desired to have a wrap strip made of a different non-cohesive material, then a coating may be applied to wrap strip 102 adjacent second end 108 on the same side of the wrap strip as pad 104, or adjacent first end 110 on a side opposite the pad. It may be desirable to have the coating on both ends of the wrap strip as well and such a construction is within the scope of the present disclosure.

Use of a cohesive wrap strip material and/or a wrap strip with a cohesive coating on one or both ends is desired so that nail coating removal wrap and retainer 100 may be more easily handled by a user. It is also desirable to have the cohesive elements to be reusable. If nail coating removal wrap and retainer 100 is placed on a client's fingernail for a certain period of time, the user may initially remove the wrap and discover that more contact or dwell time is needed to remove the nail coating. Having a reusable cohesive material will permit the user to rewrap nail coating removal wrap and retainer 100 about the fingernail to give more dwell time to soften or loosen the coating.

Solvent pad 104 is preferably selected for receiving an appropriate and effective solvent for loosening, softening and/or dissolving the adhesion between the nail and the coating. To use nail coating removal wrap and retainer 100, pad 104 may be infused with the solvent and placed on the nail plate. With the pad in place, the wrap may be passed around the user's finger or toe to secure the pad in place. The self adhesive nature of the wrap permit the pad to secure the pad in the desired position for the necessary period of time.

When sufficient time has passed, the wrap can be detached from itself and unwrapped from the finger or toe. The pad can then be removed from the user to determine if sufficient treatment has occurred for the removal of the covering. If the treatment has been sufficient the wrap can be discarded and the covering removed. If additional treatment is required, the wrap can be reapplied to the nail with or without the addition of any new solvent.

It is anticipated that the wraps according the present disclosure may be made without any pre-applied solvent and sold dry to stylists to apply the desired brand, type or amount of solvent. It is also anticipated that wraps could be made with solvents pre-applied to simplify the steps for the stylist or salon personnel. It is also anticipated that the wraps may be sold either dry or pre-treated with solvent direct to consumers for personal use.

In the illustrated example, pad 104 is preferably a poly backed 120, melt blown polypropylene material. Other suitable materials may be used which provide the ability to absorb and hold an adequate amount of solvent, resist being attacked or dissolved by the solvent, and also help to prevent the solvent from leaking through or evaporating through the back of the wrap strip when placed about a user's fingernail. It also desirable to have pad 104 selected to approximately match the size of the fingernail or toenail with coating to be removed. This will ensure limited exposure to the solvent with the user's skin adjacent the nail and allow for more efficient use of solvent. By ensuring that the solvent applied to the pad is maximally in contact with the nail coating to be removed, less solvent may be needed to remove the coating.

The illustrated nail coating removal wrap and retainer 100 has pad 104 attached to wrap strip 102 by a series or pattern of ultrasonic welds or bonds 106. It is anticipated that many current or known glues or other bonding agents may not be desirable for use in attaching the pad to the wrap strip as the solvents used to attack the nail coating may also attack the glue. Ultrasonic welding or bonding may be used to create a secure and non-soluble attachment between the pad and the base wrap. Such ultrasonic bonding may be laid in the pattern shown or some other configuration or pattern of bonding may be used between the pad and the base wrap. A pattern as shown with the bonds toward the edges may be preferably as the process of boding my inhibit the absorptive properties of the pad. Moving the bonds toward the edges may ensure that more solvent from the pad is in contact with the nail covering to be removed.

It is anticipated that other non-glue or bonding agent types of attachments between the pad and the base wrap may used within the scope of the present disclosure. It is also anticipated that a glue or bonding agent that is resistant to the types or solvents used for nail covering removal may also be used to attach the pad to the base wrap within the scope of the present disclosure.

While the invention has been described with reference to preferred embodiments, it is to be understood that the invention is not intended to be limited to the specific embodiments set forth above. Thus, it is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

What is claimed is:

1. A method of removing a durable nail covering from a nail of a user, the method comprising:

providing a nail covering removal wrap and retainer with a solvent pad ultrasonically bonded to a wrap strip having inherent cohesive properties, the solvent pad positioned on the wrap strip such that it is closer to a first end of the wrap strip than a second opposite end;

applying a solvent effective to loosen the nail covering from the nail to the solvent pad;

placing the solvent pad over the nail covering on the nail;

wrapping the wrap strip about a digit of the user to secure the solvent pad over the nail covering and overlapping the wrap strip with the first end of the wrap strip adjacent the solvent pad beneath the second opposite end of the wrap strip wherein the wrap strip is cohered to itself based upon the cohesive properties of the wrap strip to releasably secure the nail covering removal wrap and retainer to the digit of the user.

2. The method of claim 1, wherein the digit is a finger and the nail is a finger nail.

* * * * *